US011146025B2

(12) United States Patent
Lu et al.

(10) Patent No.: US 11,146,025 B2
(45) Date of Patent: Oct. 12, 2021

(54) COMPACT ELECTRICAL CONNECTOR

(71) Applicant: Amphenol East Asia Ltd., Taoyuan (TW)

(72) Inventors: Lo-Wen Lu, Taoyuan (TW); Jong-Shiun Jiang, New Taipei (TW); Chia-Te Huang, Taoyuan (TW)

(73) Assignee: Amphenol East Asia Ltd., Taoyuan (TW)

( * ) Notice: Subject to any disclaimer, the term of this patent is extended or adjusted under 35 U.S.C. 154(b) by 0 days.

(21) Appl. No.: 16/827,328

(22) Filed: Mar. 23, 2020

(65) Prior Publication Data

US 2020/0358226 A1 Nov. 12, 2020

Related U.S. Application Data

(63) Continuation of application No. 16/206,753, filed on Nov. 30, 2018, now Pat. No. 10,601,181.

(30) Foreign Application Priority Data

Dec. 1, 2017 (TW) ..... 106217949
Apr. 20, 2018 (TW) ..... 107205215

(51) Int. Cl.
*H01R 13/6581* (2011.01)
*H01R 12/71* (2011.01)
(Continued)

(52) U.S. Cl.
CPC ..... *H01R 13/6581* (2013.01); *H01R 12/716* (2013.01); *H01R 12/79* (2013.01);
(Continued)

(58) Field of Classification Search
CPC .. H01R 12/716; H01R 12/79; H01R 13/6581; H01R 13/6271; H01R 13/6272; H01R 13/6594; H01R 24/60
See application file for complete search history.

(56) References Cited

U.S. PATENT DOCUMENTS 2,996,710 A 8/1961 Pratt
3,002,162 A 9/1961 Garstang
(Continued)

FOREIGN PATENT DOCUMENTS

CN 1192068 A 9/1998
CN 2519434 Y 10/2002
(Continued)

OTHER PUBLICATIONS

Chinese Office Action dated Jan. 18, 2021 in connection with Chinese Application No. 202010031395.7.
(Continued)

*Primary Examiner* — Oscar C Jimenez
(74) *Attorney, Agent, or Firm* — Wolf, Greenfield & Sacks, P.C.

(57) ABSTRACT

An electrical connector system with a receptacle and plug. The receptacle has a metal housing encircling an insulative housing. A side wall of the metal housing is separated from a corresponding side wall of the insulative housing, leaving a groove. The plug has a wall, extending from an insulative housing of the plug, parallel to a paddle card. The metal housing may be shaped to engage with the wall during mating of the plug and receptacle, facilitating alignment of the paddle card and plug interface of the receptacle. The wall may also carry latching components, which may latch to corresponding features of the metal housing, reducing the height of the mated connectors in comparison to configurations in which the latching components are mounted to the insulative housing of the plug. The receptacle housing may have asymmetric support parts, providing support in a compact space.

20 Claims, 12 Drawing Sheets

(51) Int. Cl.

| | |
|---|---|
| ***H01R 13/627*** | (2006.01) |
| ***H01R 12/79*** | (2011.01) |
| ***H01R 13/6594*** | (2011.01) |
| ***H01R 24/60*** | (2011.01) |

(52) U.S. Cl.
CPC ..... *H01R 13/6271* (2013.01); *H01R 13/6272* (2013.01); *H01R 13/6594* (2013.01); *H01R 24/60* (2013.01)

(56) References Cited

U.S. PATENT DOCUMENTS

| | | | |
|---|---|---|---|
| 3,134,950 | A | 5/1964 | Cook |
| 3,322,885 | A | 5/1967 | May et al. |
| 3,786,372 | A | 1/1974 | Epis et al. |
| 3,825,874 | A | 7/1974 | Peverill |
| 3,863,181 | A | 1/1975 | Glance et al. |
| 4,155,613 | A | 5/1979 | Brandeau |
| 4,195,272 | A | 3/1980 | Boutros |
| 4,276,523 | A | 6/1981 | Boutros et al. |
| 4,371,742 | A | 2/1983 | Manly |
| 4,408,255 | A | 10/1983 | Adkins |
| 4,447,105 | A | 5/1984 | Ruehl |
| 4,471,015 | A | 9/1984 | Ebneth et al. |
| 4,484,159 | A | 11/1984 | Whitley |
| 4,490,283 | A | 12/1984 | Kleiner |
| 4,518,651 | A | 5/1985 | Wolfe, Jr. |
| 4,519,664 | A | 5/1985 | Tillotson |
| 4,519,665 | A | 5/1985 | Althouse et al. |
| 4,632,476 | A | 12/1986 | Schell |
| 4,636,752 | A | 1/1987 | Saito |
| 4,682,129 | A | 7/1987 | Bakermans et al. |
| 4,687,267 | A | 8/1987 | Header |
| 4,728,762 | A | 3/1988 | Roth et al. |
| 4,751,479 | A | 6/1988 | Parr |
| 4,761,147 | A | 8/1988 | Gauthier |
| 4,787,548 | A | 11/1988 | Abbagnaro et al. |
| 4,806,107 | A | 2/1989 | Arnold et al. |
| 4,846,724 | A | 7/1989 | Sasaki et al. |
| 4,846,727 | A | 7/1989 | Glover et al. |
| 4,878,155 | A | 10/1989 | Conley |
| 4,948,922 | A | 8/1990 | Varadan et al. |
| 4,970,354 | A | 11/1990 | Iwasa et al. |
| 4,975,084 | A | 12/1990 | Fedder et al. |
| 4,992,060 | A | 2/1991 | Meyer |
| 5,000,700 | A | 3/1991 | Masubuchi et al. |
| 5,066,236 | A | 11/1991 | Broeksteeg |
| 5,141,454 | A | 8/1992 | Garrett et al. |
| 5,150,086 | A | 9/1992 | Ito |
| 5,166,527 | A | 11/1992 | Solymar |
| 5,168,252 | A | 12/1992 | Naito |
| 5,168,432 | A | 12/1992 | Murphy et al. |
| 5,171,161 | A | 12/1992 | Kachlic |
| 5,176,538 | A | 1/1993 | Hansell, III et al. |
| 5,266,055 | A | 11/1993 | Naito et al. |
| 5,280,257 | A | 1/1994 | Cravens et al. |
| 5,287,076 | A | 2/1994 | Johnescu et al. |
| 5,334,050 | A | 8/1994 | Andrews |
| 5,340,334 | A | 8/1994 | Nguyen |
| 5,346,410 | A | 9/1994 | Moore, Jr. |
| 5,429,520 | A | 7/1995 | Morlion et al. |
| 5,429,521 | A | 7/1995 | Morlion et al. |
| 5,433,617 | A | 7/1995 | Morlion et al. |
| 5,433,618 | A | 7/1995 | Morlion et al. |
| 5,456,619 | A | 10/1995 | Belopolsky et al. |
| 5,461,392 | A | 10/1995 | Mott et al. |
| 5,474,472 | A | 12/1995 | Niwa et al. |
| 5,484,310 | A | 1/1996 | McNamara et al. |
| 5,496,183 | A | 3/1996 | Soes et al. |
| 5,499,935 | A | 3/1996 | Powell |
| 5,551,893 | A | 9/1996 | Johnson |
| 5,562,497 | A | 10/1996 | Yagi et al. |
| 5,597,328 | A | 1/1997 | Mouissie |
| 5,651,702 | A | 7/1997 | Hanning et al. |
| 5,669,789 | A | 9/1997 | Law |
| 5,796,323 | A | 8/1998 | Uchikoba et al. |
| 5,831,491 | A | 11/1998 | Buer et al. |
| 5,885,088 | A | 3/1999 | Brennan et al. |
| 5,924,899 | A | 7/1999 | Paagman |
| 5,981,869 | A | 11/1999 | Kroger |
| 5,982,253 | A | 11/1999 | Perrin et al. |
| 6,019,616 | A | 2/2000 | Yagi et al. |
| 6,152,747 | A | 11/2000 | McNamara |
| 6,168,469 | B1 | 1/2001 | Lu |
| 6,174,202 | B1 | 1/2001 | Mitra |
| 6,174,203 | B1 | 1/2001 | Asao |
| 6,174,944 | B1 | 1/2001 | Chiba et al. |
| 6,217,372 | B1 | 4/2001 | Reed |
| 6,293,827 | B1 | 9/2001 | Stokoe |
| 6,296,496 | B1 | 10/2001 | Trammel |
| 6,299,438 | B1 | 10/2001 | Sahagian et al. |
| 6,299,483 | B1 | 10/2001 | Cohen et al. |
| 6,322,395 | B1 | 11/2001 | Nishio et al. |
| 6,328,601 | B1 | 12/2001 | Yip et al. |
| 6,347,962 | B1 | 2/2002 | Kline |
| 6,350,134 | B1 | 2/2002 | Fogg et al. |
| 6,361,363 | B1 | 3/2002 | Hwang |
| 6,364,711 | B1 | 4/2002 | Berg et al. |
| 6,375,510 | B2 | 4/2002 | Asao |
| 6,379,188 | B1 | 4/2002 | Cohen et al. |
| 6,394,842 | B1 | 5/2002 | Sakurai et al. |
| 6,398,588 | B1 | 6/2002 | Bickford |
| 6,409,543 | B1 | 6/2002 | Astbury, Jr. et al. |
| 6,447,170 | B1 | 9/2002 | Takahashi et al. |
| 6,482,017 | B1 | 11/2002 | Van Doorn |
| 6,503,103 | B1 | 1/2003 | Cohen et al. |
| 6,506,076 | B2 | 1/2003 | Cohen et al. |
| 6,517,360 | B1 | 2/2003 | Cohen |
| 6,530,790 | B1 | 3/2003 | McNamara et al. |
| 6,537,087 | B2 | 3/2003 | McNamara et al. |
| 6,551,140 | B2 | 4/2003 | Billman et al. |
| 6,554,647 | B1 | 4/2003 | Cohen et al. |
| 6,565,387 | B2 | 5/2003 | Cohen |
| 6,565,390 | B2 | 5/2003 | Wu |
| 6,579,116 | B2 | 6/2003 | Brennan et al. |
| 6,582,244 | B2 | 6/2003 | Fogg et al. |
| 6,595,801 | B1 | 7/2003 | Leonard et al. |
| 6,595,802 | B1 | 7/2003 | Watanabe et al. |
| 6,602,095 | B2 | 8/2003 | Astbury, Jr. et al. |
| 6,607,402 | B2 | 8/2003 | Cohen et al. |
| 6,609,922 | B2 | 8/2003 | Torii |
| 6,616,864 | B1 | 9/2003 | Jiang et al. |
| 6,652,318 | B1 | 11/2003 | Winings et al. |
| 6,655,966 | B2 | 12/2003 | Rothermel et al. |
| 6,709,294 | B1 | 3/2004 | Cohen et al. |
| 6,713,672 | B1 | 3/2004 | Stickney |
| 6,726,492 | B1 | 4/2004 | Yu |
| 6,743,057 | B2 | 6/2004 | Davis et al. |
| 6,776,659 | B1 | 8/2004 | Stokoe et al. |
| 6,786,771 | B2 | 9/2004 | Gailus |
| 6,814,619 | B1 | 11/2004 | Stokoe et al. |
| 6,830,489 | B2 | 12/2004 | Aoyama |
| 6,872,085 | B1 | 3/2005 | Cohen et al. |
| 6,979,226 | B2 | 12/2005 | Otsu et al. |
| 7,044,794 | B2 | 5/2006 | Consoli et al. |
| 7,057,570 | B2 | 6/2006 | Irion, II et al. |
| 7,074,086 | B2 | 7/2006 | Cohen et al. |
| 7,086,872 | B2 | 8/2006 | Myer et al. |
| 7,094,102 | B2 | 8/2006 | Cohen et al. |
| 7,104,842 | B1 | 9/2006 | Huang et al. |
| 7,108,556 | B2 | 9/2006 | Cohen et al. |
| 7,156,672 | B2 | 1/2007 | Fromm et al. |
| 7,163,421 | B1 | 1/2007 | Cohen et al. |
| 7,232,344 | B1 | 6/2007 | Gillespie et al. |
| 7,285,018 | B2 | 10/2007 | Kenny et al. |
| 7,318,740 | B1 | 1/2008 | Henry et al. |
| 7,320,614 | B2 | 1/2008 | Toda et al. |
| 7,322,845 | B2 | 1/2008 | Regnier et al. |
| 7,331,822 | B2 | 2/2008 | Chen n |
| 7,335,063 | B2 | 2/2008 | Cohen et al. |
| 7,407,413 | B2 | 8/2008 | Minich |
| 7,467,977 | B1 | 12/2008 | Yi et al. |
| 7,473,124 | B1 | 1/2009 | Briant et al. |
| 7,494,383 | B2 | 2/2009 | Cohen et al. |

(56) References Cited

U.S. PATENT DOCUMENTS 7,540,781 B2 6/2009 Kenny et al.
7,581,990 B2 9/2009 Kirk et al.
7,588,464 B2 9/2009 Kim
7,604,502 B2 10/2009 Pan
7,645,165 B2 1/2010 Wu et al.
7,690,946 B2 4/2010 Knaub et al.
7,699,644 B2 4/2010 Szczesny et al.
7,722,401 B2 5/2010 Kirk et al.
7,727,027 B2 6/2010 Chiang et al.
7,731,537 B2 6/2010 Amleshi et al.
7,753,731 B2 7/2010 Cohen et al.
7,771,233 B2 8/2010 Gailus
7,794,240 B2 9/2010 Cohen et al.
7,794,278 B2 9/2010 Cohen et al.
7,806,729 B2 10/2010 Nguyen et al.
7,871,296 B2 1/2011 Fowler et al.
7,874,873 B2 1/2011 Do et al.
7,883,369 B1 2/2011 Sun et al.
7,887,371 B2 2/2011 Kenny et al.
7,887,379 B2 2/2011 Kirk
7,906,730 B2 3/2011 Atkinson et al.
7,914,304 B2 3/2011 Cartier et al.
7,985,097 B2 7/2011 Gulla
8,018,733 B2 9/2011 Jia
8,083,553 B2 12/2011 Manter et al.
8,123,544 B2 2/2012 Kobayashi
8,182,289 B2 5/2012 Stokoe et al.
8,215,968 B2 7/2012 Cartier et al.
8,216,001 B2 7/2012 Kirk
8,262,411 B2 9/2012 Kondo
8,272,877 B2 9/2012 Stokoe et al.
8,337,247 B2 12/2012 Zhu
8,348,701 B1 1/2013 Lan et al.
8,371,875 B2 2/2013 Gailus
8,382,524 B2 2/2013 Khilchenko et al.
8,440,637 B2 5/2013 Elmen
8,480,432 B2 7/2013 Wu
8,506,319 B2 8/2013 Ritter et al.
8,506,331 B2 8/2013 Wu
8,545,253 B2 10/2013 Amidon et al.
8,657,627 B2 2/2014 McNamara et al.
8,715,003 B2 5/2014 Buck et al.
8,715,005 B2 5/2014 Pan
8,740,637 B2 6/2014 Wang et al.
8,764,492 B2 7/2014 Chiang
8,771,016 B2 7/2014 Atkinson et al.
8,864,506 B2 10/2014 Little
8,864,521 B2 10/2014 Atkinson et al.
8,905,777 B2 12/2014 Zhu et al.
8,926,377 B2 1/2015 Kirk et al.
8,944,831 B2 2/2015 Stoner et al.
8,968,034 B2 3/2015 Hsu
8,998,642 B2 4/2015 Manter et al.
9,004,942 B2 4/2015 Paniauqa
9,011,177 B2 4/2015 Lloyd et al.
9,022,806 B2 5/2015 Cartier, Jr. et al.
9,028,281 B2 5/2015 Kirk et al.
9,065,230 B2 6/2015 Milbrand, Jr.
9,124,009 B2 9/2015 Atkinson et al.
9,219,335 B2 12/2015 Atkinson et al.
9,225,085 B2 12/2015 Cartier, Jr. et al.
9,257,794 B2 2/2016 Wanha et al.
9,263,835 B2 2/2016 Guo
9,287,668 B2 3/2016 Chen et al.
9,300,074 B2 3/2016 Gailus
9,337,585 B1 5/2016 Yang
9,350,095 B2 5/2016 Arichika et al.
9,450,344 B2 9/2016 Cartier, Jr. et al.
9,484,674 B2 11/2016 Cartier, Jr. et al.
9,509,101 B2 11/2016 Cartier, Jr. et al.
9,520,686 B2 12/2016 Hu et al.
9,520,689 B2 12/2016 Cartier, Jr. et al.
9,640,915 B2 5/2017 Phillips
9,692,183 B2 6/2017 Phillips
9,742,132 B1 8/2017 Hsueh
9,843,135 B2 12/2017 Guetig et al.
9,972,945 B1 * 5/2018 Huang ..... H01R 13/6585
9,997,871 B2 6/2018 Zhong
10,122,129 B2 11/2018 Milbrand, Jr. et al.
10,135,197 B2 11/2018 Little et al.
10,211,577 B2 2/2019 Milbrand, Jr. et al.
10,243,304 B2 3/2019 Kirk et al.
10,270,191 B1 4/2019 Li et al.
10,276,995 B2 4/2019 Little
10,283,910 B1 5/2019 Chen et al.
10,348,040 B2 7/2019 Cartier, Jr. et al.
10,381,767 B1 8/2019 Milbrand, Jr. et al.
10,431,936 B2 10/2019 Horning et al.
10,511,128 B2 12/2019 Kirk et al.
10,541,482 B2 1/2020 Sasame et al.
10,601,181 B2 * 3/2020 Lu ..... H01R 13/6594
10,777,921 B2 * 9/2020 Lu ..... H01R 12/82
10,797,446 B2 10/2020 Liu et al.
10,840,622 B2 11/2020 Sasame et al.
2001/0042632 A1 11/2001 Manov et al.
2001/0046810 A1 11/2001 Cohen et al.
2002/0042223 A1 4/2002 Belopolsky et al.
2002/0061671 A1 5/2002 Torii
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2003/0119360 A1 6/2003 Jiang et al.
2004/0005815 A1 1/2004 Mizumura et al.
2004/0020674 A1 2/2004 McFadden et al.
2004/0058572 A1 3/2004 Fromm et al.
2004/0115968 A1 6/2004 Cohen
2004/0121652 A1 6/2004 Gailus
2004/0196112 A1 10/2004 Welbon et al.
2004/0259419 A1 12/2004 Payne et al.
2005/0048818 A1 3/2005 Pan
2005/0070160 A1 3/2005 Cohen et al.
2005/0133245 A1 6/2005 Katsuyama et al.
2005/0176835 A1 8/2005 Kobayashi et al.
2005/0233610 A1 10/2005 Tutt et al.
2005/0283974 A1 12/2005 Richard et al.
2005/0287869 A1 12/2005 Kenny et al.
2006/0019525 A1 1/2006 Lloyd et al.
2006/0068640 A1 3/2006 Gailus
2006/0255876 A1 11/2006 Kushta et al.
2007/0004282 A1 1/2007 Cohen et al.
2007/0021001 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0218765 A1 9/2007 Cohen et al.
2008/0020640 A1 1/2008 Zhang et al.
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0035955 A1 2/2009 McNamara
2009/0061661 A1 3/2009 Shuey et al.
2009/0117386 A1 5/2009 Vacanti et al.
2009/0239395 A1 9/2009 Cohen et al.
2009/0258516 A1 10/2009 Hiew et al.
2009/0291593 A1 11/2009 Atkinson et al.
2009/0305530 A1 12/2009 Ito et al.
2009/0305533 A1 12/2009 Feldman et al.
2010/0048058 A1 2/2010 Morgan et al.
2010/0068934 A1 3/2010 Li et al.
2010/0081302 A1 4/2010 Atkinson et al.
2010/0112846 A1 5/2010 Kotaka
2010/0124851 A1 5/2010 Xiong et al.
2010/0203772 A1 8/2010 Mao et al.
2010/0294530 A1 11/2010 Atkinson et al.
2011/0003509 A1 1/2011 Gailus
2011/0067237 A1 3/2011 Cohen et al.
2011/0104948 A1 5/2011 Girard, Jr. et al.
2011/0143605 A1 6/2011 Pepe

(56) References Cited

U.S. PATENT DOCUMENTS

| | | | |
|---|---|---|---|
| 2011/0212649 | A1 | 9/2011 | Stokoe et al. |
| 2011/0212650 | A1 | 9/2011 | Amleshi et al. |
| 2011/0230095 | A1 | 9/2011 | Atkinson et al. |
| 2011/0230096 | A1 | 9/2011 | Atkinson et al. |
| 2011/0256739 | A1 | 10/2011 | Toshiyuki et al. |
| 2011/0287663 | A1 | 11/2011 | Gailus et al. |
| 2012/0094536 | A1 | 4/2012 | Khilchenko et al. |
| 2012/0156929 | A1 | 6/2012 | Manter et al. |
| 2012/0184145 | A1 | 7/2012 | Zeng |
| 2012/0184154 | A1 | 7/2012 | Frank et al. |
| 2012/0202363 | A1 | 8/2012 | McNamara et al. |
| 2012/0202386 | A1 | 8/2012 | McNamara et al. |
| 2012/0214344 | A1 | 8/2012 | Cohen et al. |
| 2013/0012038 | A1 | 1/2013 | Kirk et al. |
| 2013/0017733 | A1 | 1/2013 | Kirk et al. |
| 2013/0065454 | A1 | 3/2013 | Milbrand, Jr. |
| 2013/0078870 | A1 | 3/2013 | Milbrand, Jr. |
| 2013/0078871 | A1 | 3/2013 | Milbrand, Jr. |
| 2013/0090001 | A1 | 4/2013 | Kagotani |
| 2013/0109232 | A1 | 5/2013 | Paniaqua |
| 2013/0196553 | A1 | 8/2013 | Gailus |
| 2013/0217263 | A1 | 8/2013 | Pan |
| 2013/0225006 | A1 | 8/2013 | Khilchenko et al. |
| 2013/0237100 | A1 | 9/2013 | Affeltranger |
| 2013/0316590 | A1 | 11/2013 | Hon |
| 2014/0004724 | A1 | 1/2014 | Cartier, Jr. et al. |
| 2014/0004726 | A1 | 1/2014 | Cartier, Jr. et al. |
| 2014/0004746 | A1 | 1/2014 | Cartier, Jr. et al. |
| 2014/0024263 | A1 | 1/2014 | Dong et al. |
| 2014/0057498 | A1 | 2/2014 | Cohen |
| 2014/0113487 | A1 | 4/2014 | Chen et al. |
| 2014/0273557 | A1 | 9/2014 | Cartier, Jr. et al. |
| 2014/0273627 | A1 | 9/2014 | Cartier, Jr. et al. |
| 2014/0377992 | A1 | 12/2014 | Chang et al. |
| 2015/0056856 | A1 | 2/2015 | Atkinson et al. |
| 2015/0072546 | A1 | 3/2015 | Li |
| 2015/0111401 | A1 | 4/2015 | Guo |
| 2015/0111427 | A1 | 4/2015 | Wu et al. |
| 2015/0126068 | A1 | 5/2015 | Fang |
| 2015/0214673 | A1 | 7/2015 | Gao et al. |
| 2015/0236451 | A1 | 8/2015 | Cartier, Jr. et al. |
| 2015/0236452 | A1 | 8/2015 | Cartier, Jr. et al. |
| 2015/0255904 | A1 | 9/2015 | Ito |
| 2015/0255926 | A1 | 9/2015 | Paniagua |
| 2016/0149343 | A1 | 5/2016 | Atkinson et al. |
| 2016/0268744 | A1 | 9/2016 | Little et al. |
| 2017/0077654 | A1 | 3/2017 | Yao et al. |
| 2017/0352970 | A1 | 12/2017 | Liang et al. |
| 2018/0062323 | A1 | 3/2018 | Kirk et al. |
| 2018/0145438 | A1 | 5/2018 | Cohen |
| 2018/0198220 | A1 | 7/2018 | Sasame et al. |
| 2018/0205177 | A1 | 7/2018 | Zhou et al. |
| 2018/0212376 | A1 | 7/2018 | Wang et al. |
| 2018/0212385 | A1 | 7/2018 | Little |
| 2018/0219331 | A1 | 8/2018 | Cartier, Jr. et al. |
| 2018/0241156 | A1 | 8/2018 | Huang et al. |
| 2018/0269607 | A1 | 9/2018 | Wu et al. |
| 2018/0331444 | A1 | 11/2018 | Ono |
| 2019/0006778 | A1 | 1/2019 | Fan et al. |
| 2019/0052019 | A1 | 2/2019 | Huang et al. |
| 2019/0067854 | A1 | 2/2019 | Ju et al. |
| 2019/0173209 | A1 | 6/2019 | Lu et al. |
| 2019/0173232 | A1 | 6/2019 | Lu et al. |
| 2019/0334292 | A1 | 10/2019 | Cartier, Jr. et al. |
| 2020/0021052 | A1 | 1/2020 | Milbrand, Jr. et al. |
| 2020/0153134 | A1 | 5/2020 | Sasame et al. |
| 2020/0161811 | A1* | 5/2020 | Lu ..... H01R 13/516 |
| 2020/0203865 | A1* | 6/2020 | Wu ..... H01R 13/506 |
| 2020/0203867 | A1* | 6/2020 | Lu ..... H01R 13/6581 |
| 2020/0203886 | A1* | 6/2020 | Wu ..... H01R 12/62 |
| 2020/0235529 | A1 | 7/2020 | Kirk et al. |
| 2020/0259294 | A1 | 8/2020 | Lu |
| 2020/0266584 | A1 | 8/2020 | Lu |
| 2020/0335914 | A1 | 10/2020 | Hsu et al. |
| 2020/0395698 | A1 | 12/2020 | Hou et al. |
| 2020/0403350 | A1 | 12/2020 | Hsu |
| 2021/0050683 | A1 | 2/2021 | Sasame et al. |

FOREIGN PATENT DOCUMENTS

| | | | |
|---|---|---|---|
| CN | 1179448 | C | 12/2004 |
| CN | 1650479 | A | 8/2005 |
| CN | 1799290 | A | 7/2006 |
| CN | 2896615 | Y | 5/2007 |
| CN | 2930006 | Y | 8/2007 |
| CN | 101176389 | A | 5/2008 |
| CN | 101208837 | A | 6/2008 |
| CN | 101312275 | A | 11/2008 |
| CN | 201323275 | Y | 10/2009 |
| CN | 101600293 | A | 12/2009 |
| CN | 201374434 | Y | 12/2009 |
| CN | 101752700 | A | 6/2010 |
| CN | 101790818 | A | 7/2010 |
| CN | 101120490 | B | 11/2010 |
| CN | 201846527 | U | 5/2011 |
| CN | 102106041 | A | 6/2011 |
| CN | 102224640 | A | 10/2011 |
| CN | 102232259 | A | 11/2011 |
| CN | 102239605 | A | 11/2011 |
| CN | 102292881 | A | 12/2011 |
| CN | 101600293 | B | 5/2012 |
| CN | 102487166 | A | 6/2012 |
| CN | 102593661 | A | 7/2012 |
| CN | 102598430 | A | 7/2012 |
| CN | 202395248 | U | 8/2012 |
| CN | 102738621 | A | 10/2012 |
| CN | 102859805 | A | 1/2013 |
| CN | 202695788 | U | 1/2013 |
| CN | 202695861 | U | 1/2013 |
| CN | 203445304 | U | 2/2014 |
| CN | 203690614 | U | 7/2014 |
| CN | 204030057 | U | 12/2014 |
| CN | 204167554 | U | 2/2015 |
| CN | 104409906 | A | 3/2015 |
| CN | 104577577 | A | 4/2015 |
| CN | 204349140 | U | 5/2015 |
| CN | 106099546 | A | 11/2016 |
| CN | 304240766 | S | 8/2017 |
| CN | 304245430 | S | 8/2017 |
| CN | 206712089 | U | 12/2017 |
| CN | 207677189 | U | 7/2018 |
| CN | 208078300 | U | 11/2018 |
| CN | 208797273 | U | 4/2019 |
| CN | 210326355 | U | 4/2020 |
| CN | 112072400 | A | 12/2020 |
| DE | 60216728 | T2 | 11/2007 |
| EP | 0 560 551 | A1 | 9/1993 |
| EP | 1 018 784 | A1 | 7/2000 |
| EP | 1 779 472 | A1 | 5/2007 |
| EP | 2 169 770 | A2 | 3/2010 |
| EP | 2 405 537 | A1 | 1/2012 |
| GB | 1272347 | A | 4/1972 |
| JP | H3-156761 | A2 | 7/1991 |
| JP | H07302649 | A | 11/1995 |
| JP | 2001-510627 | A | 7/2001 |
| JP | 2002-151190 | A2 | 5/2002 |
| JP | 2006-344524 | A | 12/2006 |
| MX | 9907324 | A1 | 8/2000 |
| TW | M357771 | U | 5/2009 |
| TW | M474278 | U | 3/2014 |
| TW | I535129 | B | 5/2016 |
| TW | I596840 | B | 8/2017 |
| TW | M558481 | U | 4/2018 |
| TW | M558482 | U | 4/2018 |
| TW | M558483 | U | 4/2018 |
| TW | M559006 | U | 4/2018 |
| TW | M559007 | U | 4/2018 |
| TW | M560138 | U | 5/2018 |
| TW | M562507 | U | 6/2018 |
| TW | M565894 | Y | 8/2018 |
| TW | M565895 | Y | 8/2018 |
| TW | M565899 | Y | 8/2018 |
| TW | M565900 | Y | 8/2018 |

(56) References Cited

FOREIGN PATENT DOCUMENTS

| | | | |
|---|---|---|---|
| TW | M565901 | Y | 8/2018 |
| TW | M605564 | U | 12/2020 |
| WO | WO 88/05218 | A1 | 7/1988 |
| WO | WO 98/35409 | A1 | 8/1998 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124057 | A2 | 10/2008 |
| WO | WO 2010/030622 | A1 | 3/2010 |
| WO | WO 2010/039188 | A1 | 4/2010 |
| WO | WO 2017/007429 | A1 | 1/2017 |

OTHER PUBLICATIONS

Chinese Office Action for Application No. 201680051491.X dated Apr. 30, 2019.
Chinese Office Action for Chinese Application No. 201580014851.4 dated Sep. 4, 2019.
Chinese Office Action for Chinese Application No. 201780064531.9 dated Jan. 2, 2020.
Extended European Search Report for European Application No. EP 11166820.8 dated Jan. 24, 2012.
International Preliminary Report on Patentability Chapter II for International Application No. PCT/CN2017/108344 dated Mar. 6, 2020.
International Preliminary Report on Patentability for International Application No. PCT/US2010/056482 dated May 24, 2012.
International Preliminary Report on Patentability for International Application No. PCT/US2011/026139 dated Sep. 7, 2012.
International Preliminary Report on Patentability for International Application No. PCT/US2012/023689 dated Aug. 15, 2013.
International Preliminary Report on Patentability for International Application No. PCT/SG2016/050317 dated Jan. 18, 2018.
International Search Report and Written Opinion for International Application No. PCT/CN2017/108344 dated Aug. 1, 2018.
International Search Report and Written Opinion for International Application No. PCT/US2010/056482 dated Mar. 14, 2011.
International Search Report and Written Opinion for International Application No. PCT/US2011/026139 dated Nov. 22, 2011.
International Search Report and Written Opinion for International Application No. PCT/US2012/023689 dated Sep. 12, 2012.
International Search Report and Written Opinion for International Application No. PCT/US2012/060610 dated Mar. 29, 2013.
International Search Report and Written Opinion for International Application No. PCT/U52015/012463 dated May 13, 2015.
International Search Report and Written Opinion for International Application No. PCT/US2017/047905 dated Dec. 4, 2017.
International Search Report and Written Opinion for International Application No. PCT/US2005/034605 dated Jan. 26, 2006.
International Search Report and Written Opinion for International Application No. PCT/US2011/034747 dated Jul. 28, 2011.
International Search Report and Written Opinion for International Application No. PCT/SG2016/050317 dated Oct. 18, 2016.
International Search Report with Written Opinion for International Application No. PCT/US2006/025562 dated Oct. 31, 2007.
[No Author Listed], Carbon Nanotubes for Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
[No Author Listed], High Speed Backplane Connectors . Tyco Electronics. Product Catalog No. 1773095. Revised Dec. 2008 1-40 pages.
[No Author Listed], Military Fibre Channel High Speed Cable Assembly. www.gore.com. 2008. [last accessed Aug. 2, 2012 via Internet Archive: Wayback Machine http://web.archive.org] Link archived: http://www.gore.com/en.sub.--xx/products/cables/copper/networking/military/military.sub.--fibre . . . Last archive date Apr. 6, 2008.
[No Author Listed], SFF-TA-1016 Specifiation for Internal Unshielded High Speed Connector System. Rev 0.0.1. SNIA SFF TWG Technology Affiliate. Nov. 15, 2019. 40 pages.
Beaman, High Performance Mainframe Computer Cables. 1997 Electronic Components and Technology Conference. 1997;911-7.
Jiang, High-Frequency Electrical Connector With Interlocking Segments, U.S. Appl. No. 17/089,905, filed Nov. 5, 2020.
Jiang, High-Frequency Electrical Connector With Lossy Member, U.S. Appl. No. 17/089,934, filed Nov. 5, 2020.
Lu et al., High Speed Card Edge Connector, U.S. Appl. No. 17/020,475, filed Sep. 14, 2020.
Reich et al., Microwave Theory and Techniques. Boston Technical Publishers, Inc. 1965;182-91.
Shi et al. Improving Signal Integrity in Circuit Boards by Incorporating Absorbing Materials. 2001 Proceedings. 51st Electronic Components and Technology Conference, Orlando FL. 2001:1451-56.

* cited by examiner

COMPACT ELECTRICAL CONNECTOR

CROSS-REFERENCE TO RELATED APPLICATIONS

This application is a continuation of U.S. application Ser. No. 16/206,753, filed Nov. 30, 2018, which claims priority to and the benefit of Taiwanese Patent Application Serial No. 107205215, filed Apr. 20, 2018, entitled "CONNECTOR WITH SINGLE SIDE SUPPORT AND CORRESPONDING BUTT RECESS AND INSULATING BODY THEREOF," as well as Taiwanese Patent Application Serial No. 106217949, filed Dec. 1, 2017, entitled "CONNECTOR WITH BUTTING SLOT." The entire contents of these applications are incorporated herein by reference in their entirety.

BACKGROUND

This disclosure relates generally to electrical interconnection systems and more specifically to compact electrical connectors.

Electrical connectors are used in many electronic systems. In general, various electronic devices (such as smart phones, tablet computers, desktop computers, notebook computers and digital cameras) have been provided with various types of connectors so that the electronic devices can exchange data with each other. Therefore, it can be seen that the connectors can be used for electrical connection and signal transmission between devices, between components and between systems, and are basic components needed to make a complete system.

It is generally easier and more cost effective to manufacture a system as separate electronic assemblies, such as printed circuit boards ("PCBs"), which may be joined together with electrical connectors. In some scenarios, the PCBs to be joined each have connectors mounted to them, which may be mated to directly interconnect the PCBs.

In other scenarios, the PCB's are connected through a cable. Connectors may nonetheless be used to make such connections. The cable may be terminated at least one end with a plug connector. A PCB may be equipped with a receptacle connector into which the plug connector can be inserted, making connections between the PCB and the cable. A similar arrangement may be used at the other end of the cable, connecting the cable to another PCB, so that signals may pass between the printed circuit boards through the cable.

Cables often are manufactured with desirable electrical properties to pass signals between PCBs. These properties may include low attention and uniform impedance. It is often desirable to maintain these desirable electrical properties though mated plug and receptacle connectors so that signal may travel the full path between interconnected PCBs without significant impact on signal integrity. It is a challenge, however, to design a connector that provides desirable electrical properties, while meeting other requirements, such as occupying a small volume or providing reliable operation.

SUMMARY

In accordance with some embodiments, a receptacle connector comprises an insulative body, comprising a front side configured with a plug interface, the plug interface comprising an accommodation space in the insulative body. The receptacle connector also comprises a plurality of metal terminals embedded in the insulative body, the metal terminals comprising front ends exposed in the accommodation space, and rear ends extending from a rear end of the insulative body; and a metal housing bounding an assembly space running through front and rear sides, wherein the insulative body extends into and is fixed within the assembly space. The metal housing may comprise a first side wall comprising at least one snap-fit hole and is at a distance from a corresponding side face of the insulative body to form an abutting groove. The abutting groove may be positioned to receive an abutting wall of a further connector when the further connector is mated with the connector such that a plurality of terminals of the further connector extend into the accommodation space and are electrically connected to the metal terminals. The at least one snap-fit hole may be positioned to receive at least one projecting block mounted to an outer side of the abutting wall.

In accordance with some embodiments, an insulative housing for an electrical connector may comprise: a single-side support part and an abutting recess, which can extend into a metal housing and can be embedded with a plurality of metal terminals, with a side face of the insulative body being at a distance from a first side wall of the metal housing to form an abutting groove; an abutting recess recessed at the periphery of a top face of the insulative body corresponding to the side face, at least one first support part protruding outward from an outer side of the corresponding other side face of the insulative body. When the connector is mounted to a circuit board, a bottom face of the first support part can abut against a surface of the circuit board. When a further connector is plugged in the connector, an abutting protrusion of the further connector can be accommodated in the abutting recess.

In accordance with other embodiments, a receptacle connector, comprises: an insulative body comprising a front side configured with a plug interface, the plug interface comprising an accommodation space in the insulative body; a plurality of metal terminals embedded in the insulative body, the metal terminals comprising front ends exposed in the accommodation space, and rear ends extending from a rear end of the insulative body; and a metal housing bounding an assembly space running through front and rear sides, wherein the insulative body extends into and is fixed within the assembly space. The metal housing may comprise a first side wall comprising at least one snap-fit hole and may be at a distance from a corresponding side face of the insulative body to form an abutting groove. The at least one snap-fit hole may be positioned to be at least partially below the front side.

In yet other embodiments, a plug connector may comprise an insulative housing; a terminal board extending from the insulative housing; an insulative abutting wall, extending from the insulative housing parallel to the terminal board; a springy member carried on the abutting wall; and at least one projecting block attached to and protruding from the springy member in a direction away from the terminal board.

Techniques and components of the foregoing embodiments may be used alone or in any suitable combination.

BRIEF DESCRIPTION OF DRAWINGS

For a better understanding of the disclosed technology, reference is made to the accompanying drawings, in which.

Figure 1:
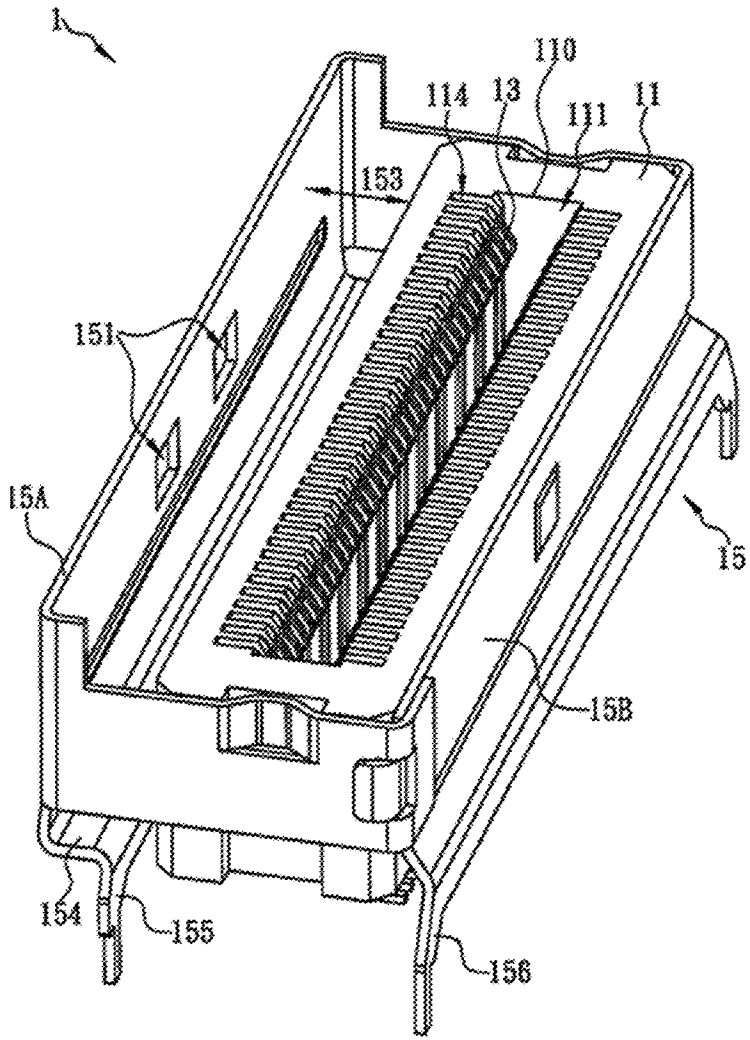
FIG. 1 is a perspective view of an exemplary embodiment of a receptacle connector.

In the drawings, the following reference numbers are used:

Connector . . . 1
Insulative body . . . 11
Plug interface . . . 110
Accommodation space . . . 111
Terminal slot . . . 114
Support part . . . 115
Front Surface . . . 116
Metal terminal . . . 13
Metal housing . . . 15
First side wall . . . 15A
Second side wall . . . 15B
First end wall . . . 15C
Second end wall . . . 15D
Assembly space . . . 150
Snap-fit hole . . . 151
Abutting groove . . . 153
Bearing part . . . 154
Pin . . . 155, 156
Upper edge . . . 157
Connector . . . 1'
Insulative body . . . 11'
Further connector . . . 2
Terminal board . . . 21
Cable Opening . . . 22
Abutting wall . . . 23
Springy member . . . 230
Projecting block . . . 231
Pressing piece . . . 232
Plug interface . . . 210
Accommodation space . . . 211
Terminal slot . . . 214
First support part . . . 216
Inclined surface . . . 2161
Abutting recess . . . 218
Relieved portion . . . 219
Relieved portion . . . 220
Metal housing . . . 25
First side wall . . . 25A
Extending portion . . . 25C1
Assembly space . . . 250
Snap-fit hole . . . 251
Abutting groove . . . 253
Further connector . . . 3
Terminal board . . . 31
Abutting wall . . . 33
Pressing piece . . . 330
Projecting block . . . 331
Abutting protrusion . . . 332
Axis . . . L
Acute angle . . . θ

DETAILED DESCRIPTION

The inventors have recognized and appreciated design techniques for electrical connectors that enable mated plug and receptacle connectors to occupy a small volume while providing reliable operation for high integrity signal interconnects. Techniques as described herein may lead to compact, but robust connectors, less likely to be damaged during mating.

The inventors have further recognized and appreciated that, although each metal terminal of a receptacle connector has been carefully soldered onto a circuit board during the production of electronic devices using the connector, the connector during use will be mated with a further connector. It is preferred that, during mating, the direction of applied force is parallel to the axial direction of the receptacle connector. However, in practice, a user will not pay special attention to the angle at which the plug is inserted into the receptacle. Thus, the receptacle connector is often subject to an external force that is not parallel to the axial direction of the connector, causing the connector to tilt. In some situations, the force will be sufficient to separate the metal terminals from the printed circuit board, so that the connector loses its function, which in turn affects the normal operation of the electronic devices.

Techniques as described herein may reduce such forces and/or the resulting damage. One such technique is the incorporation of a space between the receptacle connector housing and a metal shell. An example of such a space, used as an example of this technique below, is an abutting groove. The abutting groove may abut both the connector housing and the metal shell.

Such a space may receive a projection from the housing of a plug connector. An example of such a projection, used as an example of this technique below, is an abutting wall.

In some embodiments, the metal shell of the receptacle connector may have openings that engage with complementary latching elements on the plug connector. The latching elements may be attached to the projection, enabling the openings and the latching elements to engage closer to the printed circuit board than latching elements mounted to the plug connector housing of known connectors that lacked such a projection. The mated height of the receptacle and plug, measured normal to the surface of a printed circuit board to which the receptacle connector is mounted, may therefore be smaller, leading to a more compact connector.

In some embodiments, a connector may have an abutting groove. The connector may comprise an insulative body, a plurality of metal terminals and a metal housing, wherein the metal terminals can be fixed in the insulative body, and the insulative body, together with the metal terminals, can be assembled into the metal housing. The connector may be characterized in that a first side wall of the metal housing is provided with at least one snap-fit hole and is at a distance from a corresponding side face of the insulative body to form an abutting groove. Where a further connector is plugged in the connector, a plurality of terminals of the further connector can extend into an accommodation space via a plug interface and are electrically connected to the metal terminals, an abutting wall of the further connector can extend into the abutting groove, and at least one projecting block protruding from an outer side of the abutting wall can be embedded in the corresponding snap-fit hole. As such, during mating of the connectors, the abutting groove can play a guiding role and guide the abutting wall of the further connector to extend into the abutting groove, such that the user can correctly mate the connectors. Moreover, with the design of the snap-fit hole and the projecting block, the connectors can be stably mated.

In some embodiments, the height of the first side wall is higher than the height of the other side walls of the metal housing, so that the abutting wall of the further connector can be more easily engage an inner side face of the first side wall and slide into the abutting groove along the inner side face of the first side wall. In this way, the first side wall may guide a plug into a receptacle to facilitate mating, reducing the risk of damage to both the plug and receptacle connectors during mating.

In yet other embodiments, two opposing end walls of the metal housing, adjacent to the first side wall, may be configured to further assist in guiding the plug into the receptacle during mating. The two opposing end walls may have a height in a local region adjacent to the first side wall higher than the height of the remaining end wall of the metal housing. The height of the opposing end walls in that local region, for example, may be equal to the height of the first side wall. The height of the opposing end walls outside that local region, for example, may be equal to the height of the insulative body. The abutting wall of the plug connector can be constrained between the first side wall and its two adjacent end walls and thus can be guided into the abutting groove.

In yet other embodiments, the bottom of the first side wall may be oriented towards the abutting groove to form a bearing part, so that when the abutting wall of the plug connector is pushed into the abutting groove during mating of the plug and receptacle, the bottom face of the abutting wall can abut against the bearing part so as to avoid over-pressing of the plug connector on the receptacle.

Further, the inventors have recognized and appreciated that in some compact connectors, a pressing part, which when pressed releases the latching of a plug to a receptacle connector, may have a small range of motion. With a small range of motion, there is a risk of improper operation of the release mechanism which may lead to a user to place a relatively large amount of force of the connectors as the user attempts to un-mate the connectors while they are still latched to one another. Designs of the housings of the plug and receptacle to provide a greater range of motion can increase the reliability of the latch release mechanism, reducing the chances that the connectors will be damaged in use. In some embodiments, an insulative body may be formed with an abutting recess at the periphery of a top face of the insulative body corresponding to the side face that bounds the abutting groove. When a further connector is mated with the connector, an abutting protrusion of the further connector can be accommodated in the abutting recess, so as to form a relieved portion in the abutting wall. The abutting recess may provide a localized region of the abutting groove that is wider than other portions of the abutting groove. A latching component of the plug connector may be positioned to be within this localized region, allowing a greater range of motion of a pressing piece of the latching component. Such a greater range of motion may lead to more certain disengagement of the latching component of the plug connector form corresponding latching components of the receptacle connector, making it easier to de-mate the connectors and/or reducing the risk of damage to one of the connectors that might result from a user pulling on a plug that is still partially latched to a receptacle connector.

The inventors have also recognized and appreciated that large and unbalanced forces may also be applied to a connector during de-mating. A plug, for example, may including latching components that engage complementary latching components on a receptacle connector. To un-mate the connectors, a user must press on a release mechanism on one side of the connector. That pressing force may cause the receptacle to tilt, creating the risk that the metal terminals will detach from the printed circuit board or the connector will be otherwise damaged. That risk may be particularly high for miniaturized electronic parts that are made of thin materials. However, the inventors have recognized and appreciated that such risks may be abated with a connector housing that provides a support, to resist tilting of the connector that could detach the metal terminals from a printed circuit board, on only one side of the connector to reduce the size of the connector. That support may be provided opposite the side of the connector at what latching components are attached.

In yet other aspects, the receptacle connector may have a first support part that protrudes outward from an outer side of the insulative body that is on the opposite side of the connector from the snap-fit hole. Such a housing may have asymmetric support parts, such as by having a support part protruding from the housing on only one side. Such a connector may be compact. Yet, when the connector is mounted to a circuit board, a bottom face of the first support part can abut against a surface of the circuit board.

A connector using some or all of these techniques may be compact, with a low height. The connector may have a width comparable to a connector that is taller, by forming the connector housing with thin walls. Techniques as described herein nonetheless enable reliable operation as the connector can withstand stresses that occur during use, including during mating and other operating conditions, such as when force is exerted on a cable to which a plug is connected.

These, and other techniques as described herein, may be used alone or in any suitable combination, examples of which are provided in the exemplary embodiments described below.

Figure 2:
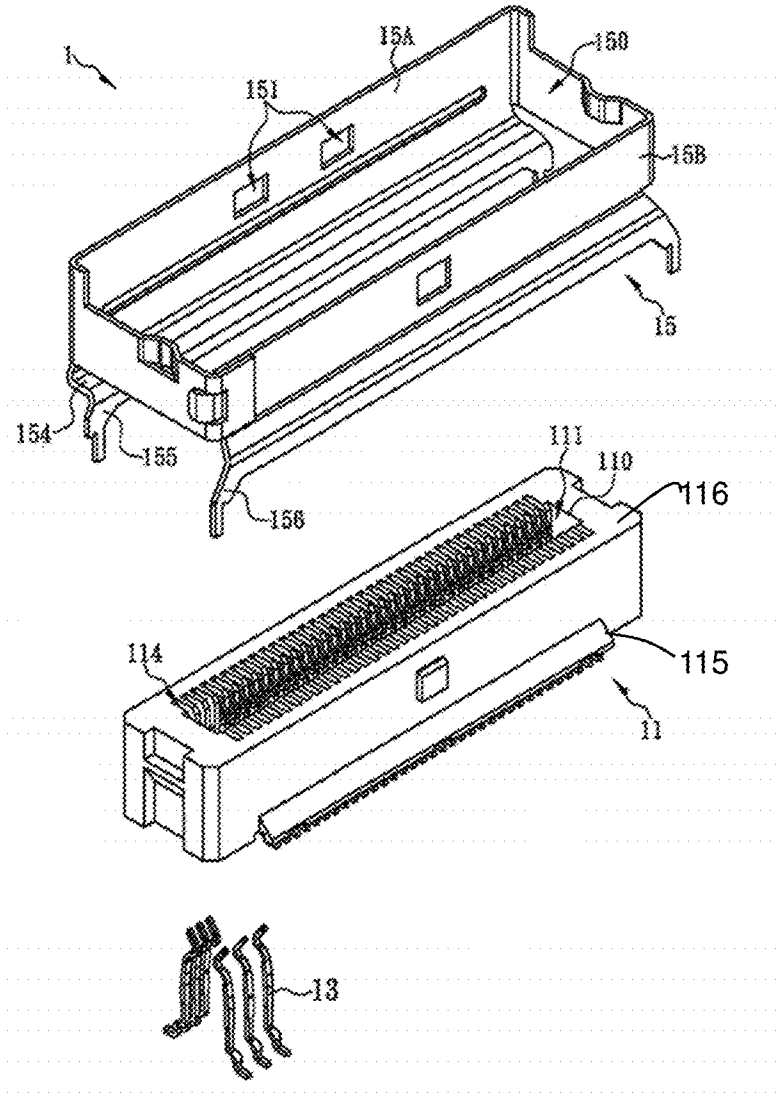
FIG. 2 is a partially exploded view of the connector of FIG. 1.
Figure 3:
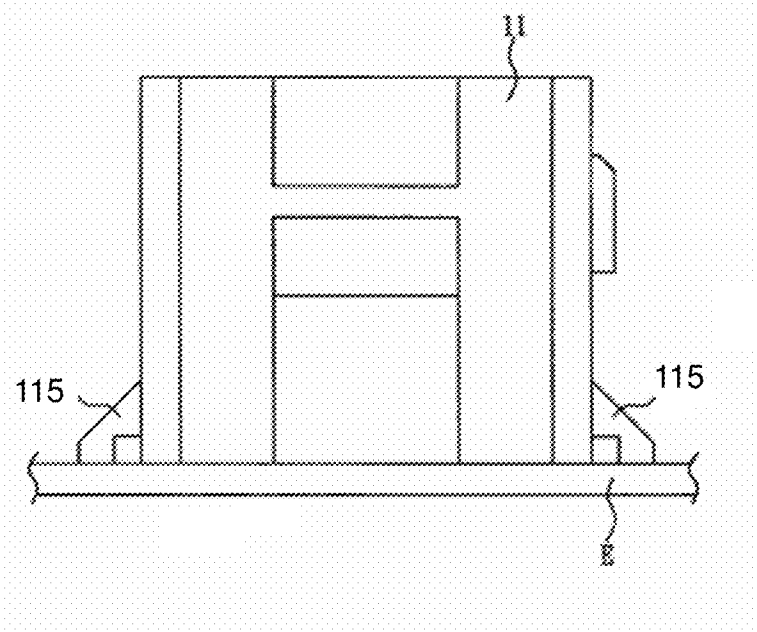
FIG. 3 is a schematic view of an insulation base of a connector.

Referring to FIGS. 1, 2 and 3, in an embodiment, connector 1 comprises an insulative body 11, a plurality of metal terminals 13 and a metal housing 15. For convenience, the upper part in FIG. 1 is taken as a front side the connector 1, while the lower part in FIG. 1 is taken as a rear side of the connector. Connector 1 is configured as a receptacle connector. The rear side of connector 1 is configured to be mounted to a printed circuit board E (FIG. 3). The front side is configured to provide a mating interface, where connector 1 may mate with a plug connector.

In the illustrated embodiment, the insulative body 11 is provided at a front side with a plug interface 110. The front surface 116 of insulative body 11 is shaped to mechanically receive a mating component, such as a paddle card, of a plug connector. Here, insulative body 11 has an accommodation space 111, forming a portion of the plug interface 110, as the mating component of the plug may fit within accommodation space 111.

Two opposite inner side faces of the insulative body 11 bounding accommodation space 111 are respectively provided with a plurality of terminal slots 114. Terminals within the terminal slots 114 are exposed to the accommodation space 111 such that they may make mechanical and electrical contact with a mating component of a plug connector inserted in accommodation space 111.

However, connector 1 may be configured in other ways to provide a mating interface to another connector. For example, in other embodiments, the insulative body 11 may have no terminal slots 114, or a tongue plate may additionally be provided in the insulative body 11 and the terminal slots 114 may be provided on the tongue plate. As such, the structure of the present disclosure can be applied to various types of connectors 1.

Figure 4:
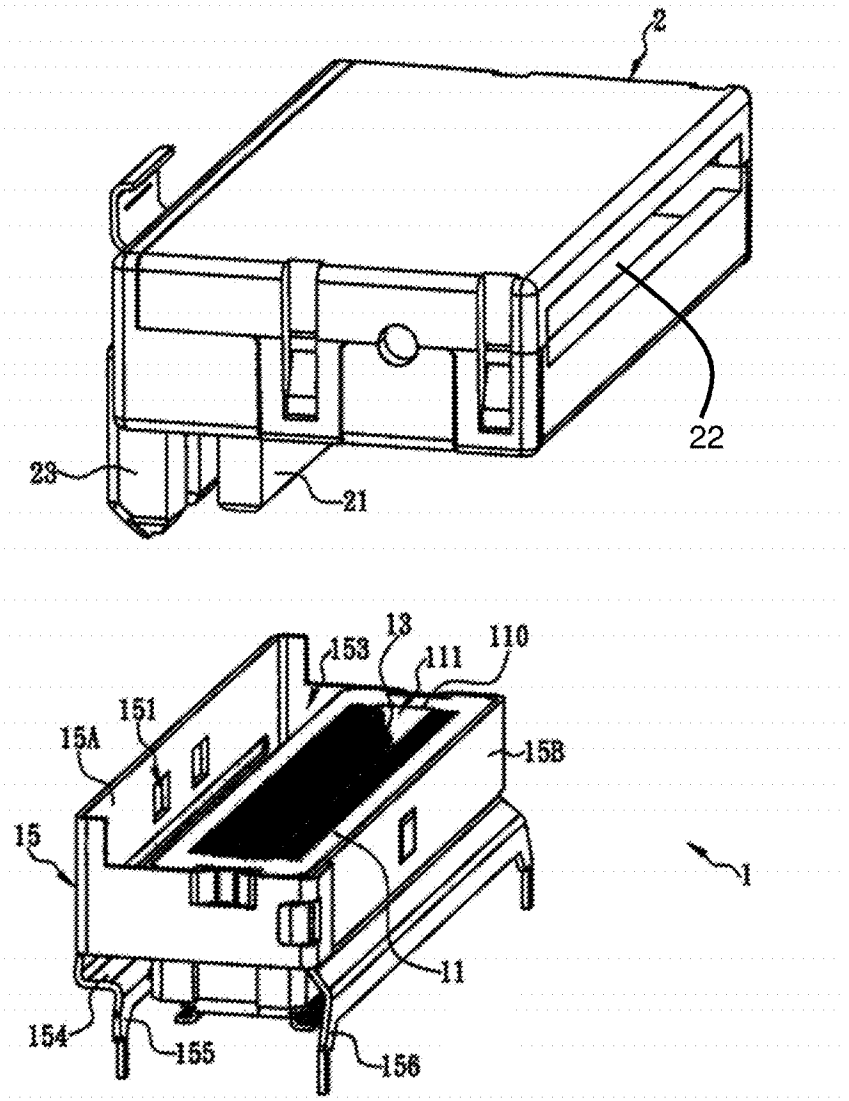
FIG. 4 is a perspective view of the receptacle connector of FIG. 1 in combination with a plug connector.

Referring to FIG. 2, the metal terminals 13 are respectively fixed in the insulative body 11 and are separated from each other at a distance. In this embodiment, the metal terminals 13 can be of different types, such as signal terminal, ground terminal, power terminal, etc., and can be embedded into the respective terminal slots 114. Front ends of the metal terminals 13 may serve as mating contact portions and may be exposed in the accommodation space 111 (as shown in FIG. 1) so as to be electrically connected to terminals of the further connector 2 (FIG. 4).

Insulative base 11 may include support parts 115 to aid in stably mounting connector 1 to circuit board E. Support parts 115 respectively protrude outward from outer sides of two opposite side faces thereof, so that where the insulative base 11 is mounted to a circuit board, bottom faces of the two support parts 115 abut against a top face of the circuit board, so as to stabilize the connector 1. During assembly or use of the connector 1 (for example, when inserting a plug into connector 1), when the insulation base 11 is subject to an external force that is not parallel to its axis, support parts 115 support the bending load of the insulative base 11 that is caused by the external force. The bottom face of the insulative base 11 can be stably maintained relative to the printed circuit board so as to avoid the adverse case that the insulation base 11 is tilted excessively under the external force and metal terminals 13, which are tilted with the insulation base 11, are disengaged from the circuit board.

Referring to FIG. 2, in this embodiment, the metal housing 15 is formed by bending a metal plate. Where the metal plate is bent into a frame shape, an assembly space 150 running through front and rear sides will be enclosed by the frame. Insulative body 11 can extend into the assembly space 150 and may be fixed in the metal housing 15 (as shown in FIG. 1). In this configuration, metal housing 15 may prevent electromagnetic interference (EMI), serve as a grounding route, and/or protect the insulative body 11. Metal housing 15 may also form a portion of the latching structure that latches a plug connector to connector 1. At least one snap-fit hole 151 is provided in a first side wall 15A of the metal housing 15, which may engage a complementary latching feature of plug connector mated with connector 1.

Metal housing 15 may be shaped to enable a complementary latching feature of a plug connector to engage the at least one snap-fit hole 151 with a low height of the mated connectors. An inner side face of the first side wall 15A is at a distance from a side face corresponding to the insulative body 11 to form an abutting groove 153. That is, the assembly space 150 is greater than the volume of the insulative body 11, such that after the insulative body 11 is assembled to the metal housing 15, a gap between the two will form the abutting groove 153.

Referring to FIG. 4, a further connector 2, configured as a plug, is shown aligned with a receptacle connector 1. Further connector 2 is configured for terminating a cable. A cable opening 22, through which a cable may pass to the interior of an insulative housing of further connector 2. Inside the housing, conductors of the cable may be attached to terminals of the connector 2. For simplicity of illustration, the cable is not show in FIG. 4.

Further connector 2 has a mating component, here shown as a terminal board 21. Terminal board 21 may be implemented as a paddle card. A paddle card, for example, may have a plurality of pads (not shown) on one or more surfaces that act as terminals for mating with connector 1. When the further connector 2 is mated with connector 1, the terminal board 21 can extend into the accommodation space 111 such that the terminals thereon are electrically connected to front ends of the metal terminals 13 so as to exchange signals with each other. Further, rear ends of the metal terminals 13 will extend from a rear end of the insulative body 11 for electrical and mechanical attachment to a circuit board. In the illustrated embodiment, terminals 13 are configured for surface mount soldering to a circuit board, but other attachment techniques may be employed.

Figure 5:
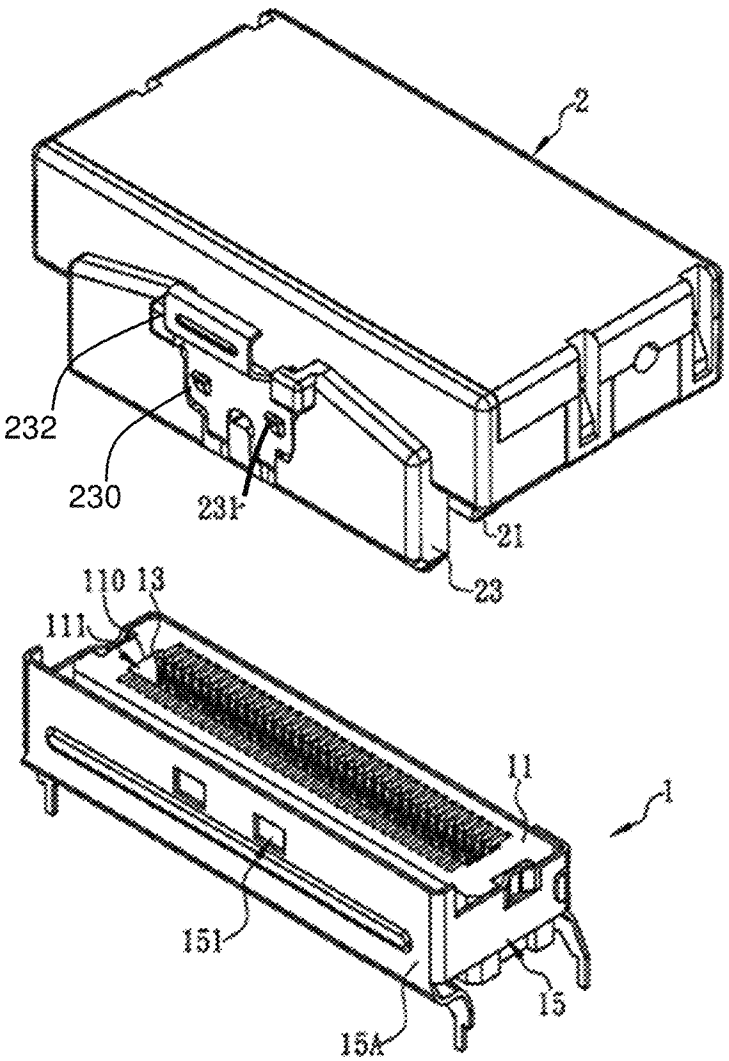
FIG. 5 is a perspective view of the receptacle connector and plug connector of FIG. 4, shown from an alternative perspective.

Referring to FIGS. 4 and 5, the further connector 2 is provided with a projection, here shown as an abutting wall 23. Abutting wall 23 extends from the insulative housing of plug connector 2 in an extension direction that is the same as that of the terminal board 21. Both extend in the mating direction in which connector must be pressed into connector 1 for mating. In this configuration, abutting wall 23 is parallel to and separated by a distance from the terminal board 21.

Abutting wall 23 may provide a place for attachment of latching components that engage with latching components on connector 1. Here, the latching components on plug connector 2 include projecting blocks 231, which fit within snap-fit holes 151 when the plug and receptacle connectors are mated. At least one projecting block 231 protrudes from an outer side face of the abutting wall 23. In the embodiment illustrated, there are two projecting blocks 231.

Projecting blocks 231 are formed on a springy member 230, mounted to abutting wall 23. That springy member, for example, may be a sheet of metal that is bent or otherwise formed to have a portion that is attached to abutting wall 23 and a portion that stands off the surface of abutting wall 23. Projecting blocks 231 are formed on the portion of the springy member 230 that stands off from abutting wall 23. Projecting blocks 231 may be formed, for example, by cutting tabs in the portion that stands off the surface. Other portions of the springy member may form a pressing piece 232, which may be pressed by a user to force the portion of the springy member with projecting blocks 231 towards the surface of abutting wall 23. When pressed towards the surface of abutting wall 23, projecting blocks 231 are pulled out of snap-fit holes 151.

In the state shown in FIG. 5, the springy member 230 is in a position in which projecting blocks 231 are held away from surface of abutting wall 23. Projecting blocks 231 have a ramped shape, and may act as camming surfaces to press the springy member towards the surface of abutting wall 23 as they engage first side wall 15A as the further connector 2 is plugged into the connector 1.

Figure 6:
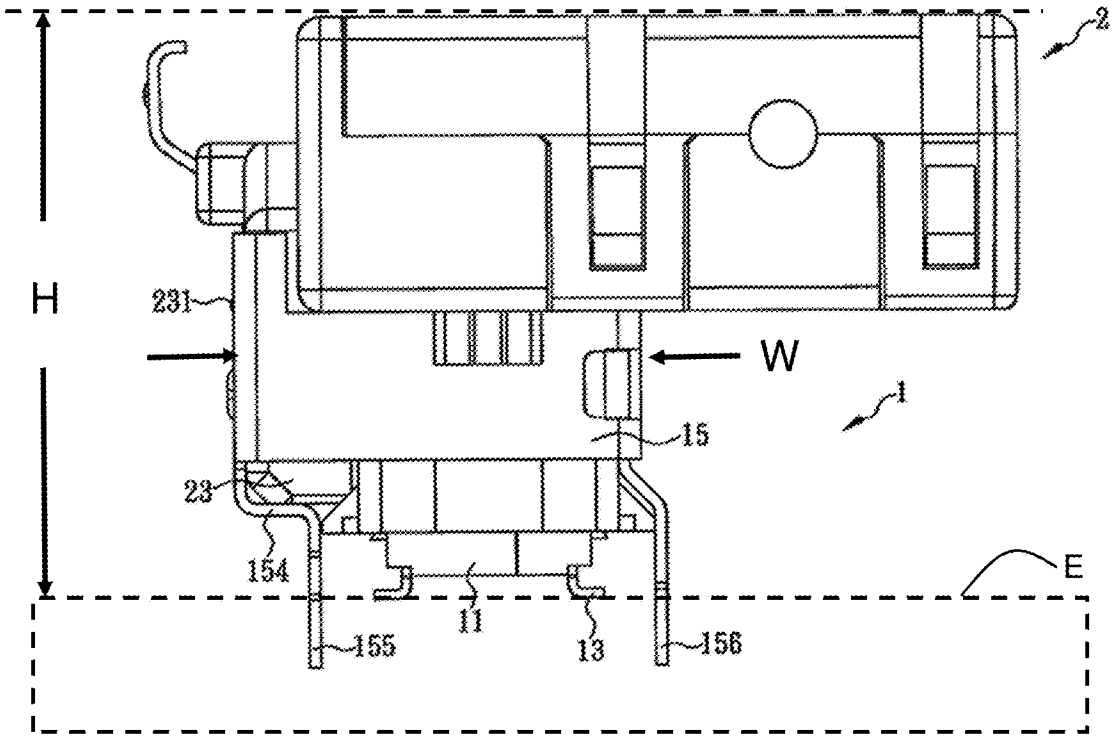
FIG. 6 is a side view of the receptacle and plug connectors of FIG. 4 in a mated configuration.

When the further connector 2 is inserted into the connector 1 (as shown in FIG. 6), the abutting wall 23 of the further connector 2 extends into the abutting groove 153, and at the same time, the projecting blocks 231 can extend into the corresponding snap-fit holes 151. In this state, the further connector 2 is latched to connector 1, because the upward edges of projecting blocks 231 engage an upper edge of 157 (FIG. 7) of snap-fit holes 151.

With the design of the abutting groove 153 and the snap-fit hole 151, the following effects can be achieved:

(1) When the length of the abutting wall 23 can be greater than that of the terminal board 21, during the assembly of the connectors 1 and 2, the abutting wall 23 will first extend into the abutting groove 153 and is guided by the abutting groove 153, such that the terminal board 21 can be inserted into the accommodation space 111 of the insulative body 11 in a correct direction so as to avoid over-pressing of the terminal board 21 to the metal terminals 13 to cause deformation and damage to the metal terminals 13;

(2) when the further connector 2 is plugged into the connector 1 by a user in a wrong direction, the abutting wall 23 and the abutting groove 153 can achieve a fool-proof effect, so that the user can plug the connectors 1 and 2 again in the correct direction; and (3) with the structure of the projecting block 231 and the snap-fit hole 151, both the further connector 2 and the connector 1 can be fixed to the same metal housing 15 at the same time so as to ensure the assembly stability of the connectors 1 and 2.

Referring to FIG. 4 again, in order to simplify the demands on a user mating connectors 1 and 2, the height of the first side wall 15A can be higher than that of the other side walls of the metal housing 15, so that the abutting wall 23 can be more easily pressed against the first side wall 15A and slide into the abutting groove 153 along the inner side face of the first side wall 15A. Further, two opposite end walls 15C and 15D of the metal housing 15 adjacent to the first side wall 15A may have a height of a local region adjacent to the first side wall 15A equal to the height of the first side wall 15A and higher than the height of the remaining end wall of the metal housing 15. As such, where the abutting wall 23 of the further connector 2 extends into the abutting groove 153, the abutting wall 23 will be positioned by the first side wall 15A and two adjacent opposite end walls 15C and 15D, and then can correctly extend into the abutting groove 153, so that the user can quickly and correctly assemble the connectors 1 and 2.

In this embodiment, referring to FIGS. 4 and 6 again, the bottom of the first side wall 15A will first bend toward the abutting groove 153 to form a bearing part 154. As such, where the abutting wall 23 of the further connector 2 extends into the abutting groove 153, the bottom face of the abutting wall 23 can abut against the bearing part 154 (as shown in FIG. 6), so that the user is limited in their ability to press the further connector 2 into the receptacle connector 1. In this way, the user receives tactile feedback that further connector 2 is fully inserted into receptacle connector 1. Additional force applied by the user after the connectors are fully mated is taken up by abutting wall 23 and bearing part 154, preventing the user from applying excessive force on the terminals of connectors 1 and 2, which could cause damage to the connector 1.

In addition, in this embodiment, the bearing part 154 can bend again to the rear of the metal housing 15, and can form at least one pin 155, which may be soldered, welded or otherwise attached to a printed circuit board to which the connector is mounted. Pin 155 may provide support for bearing part 154, increasing the amount of stress it can withstand. Further, the bottom of the second side wall 15B of the metal housing 15 opposite the first side wall 15A may also be bent to form at least one pin 156, which may also be attached to a printed circuit board to provide further support. The bending direction of the second side wall 15B will be the same as that of the first side wall 15A, so that the metal housing 15 has better strength and is not easily deformed by external forces.

FIG. 6 is a side view of connector 1 and further connector 2 in a mated configuration. Projecting blocks 231 can be seen extending through snap-fit holes, such that a portion of projecting blocks 231 is visible outside of metal housing 15. As can be seen in this view, as a result of having latching components carried on the abutting wall 23, the latching components of connector 1 and further connector 2 may be adjacent insulative body 11 when connector 1 and further connector 2 are mated. The latching components may be partially or totally below front surface 116. In contrast to other designs in which latching components are carried on the insulative housing of further connector 2, the height H of the mated connectors may be less.

Figure 8:
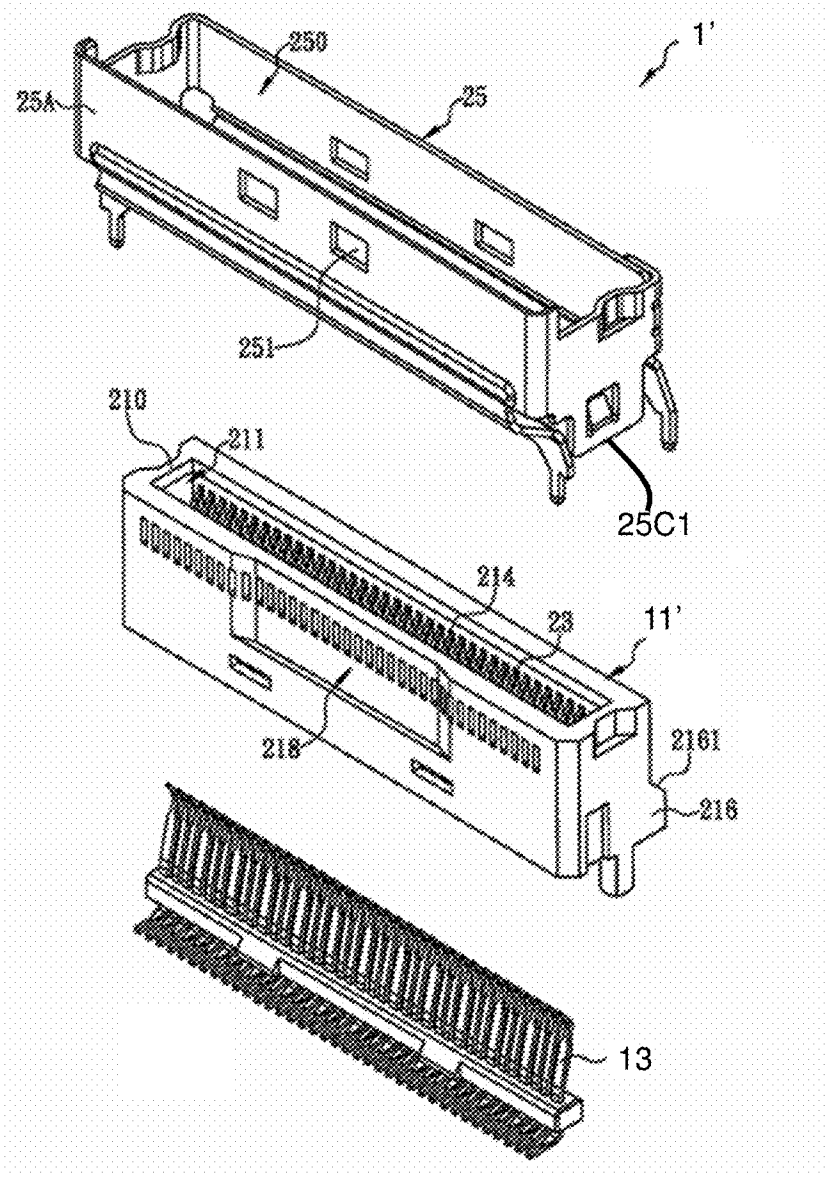
FIG. 8 is a partially exploded view of an alternative embodiment of a receptacle connector.

In addition, the width, W, of the receptacle connector may also be made small. Such reduction in size may be achieved in part by reducing the thickness of the walls of the insulative body being made thinner, including those bounding the accommodation space. For example, the width of the accommodation space may match a thickness of a paddle card set in a specification, such that reduction in width cannot be achieved by reducing the width of the accommodation space. The width, W, for example, may be less than 8 mm or less than 7 mm, in some embodiments, such as between 6 and 7 mm, such as 6.82 mm, for example. Nonetheless, techniques as described herein, including, for example an asymmetric support part, such as is shown in FIG. 8 (below) may nonetheless result in a robust connector with such a reduced width. Moreover, techniques as described herein, such as a recess 218, enables reliable operation with low stress, even with such a reduced width.

Figure 7:
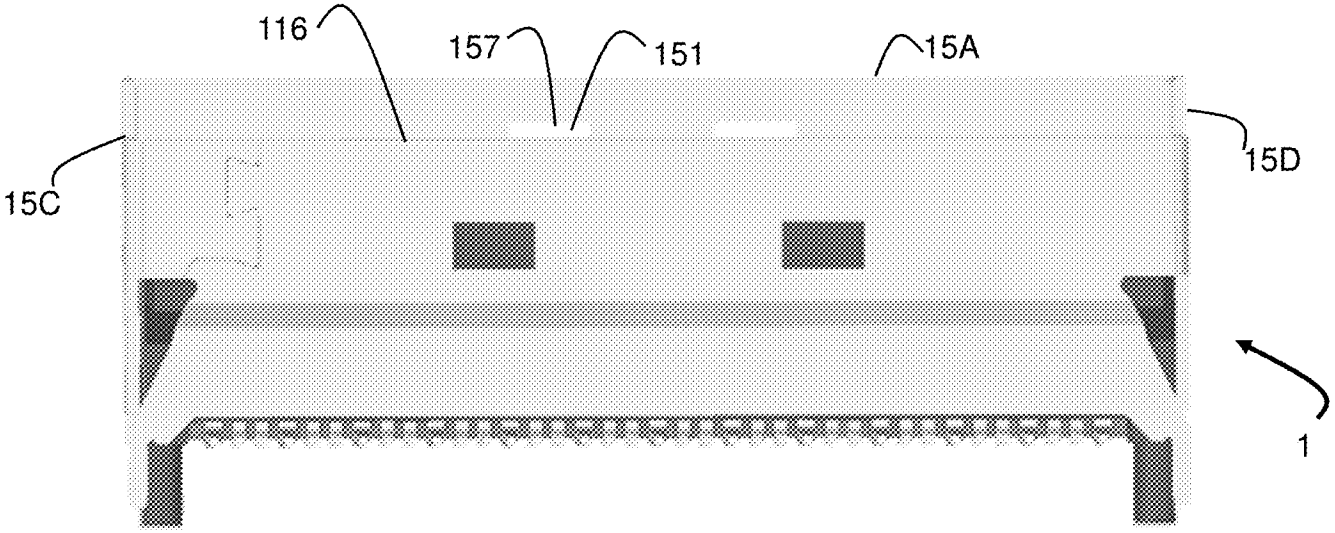
FIG. 7 is a side view of a receptacle connector.

FIG. 7 is a side view of a connector 1 showing the relative height of the upper edges 157 of snap-fit holes 151 and front surface 116. In this embodiment, snap-fit holes 151 are aligned with front surface 116, such that a portion of snap-fit holes 151 are below front surface 116. The portions of snap-fit holes 151 below front surface 116 are obscured by insulative body 11 and the second side wall 15B of metal housing 15. As can be seen in the embodiment of FIG. 7, upper edges 157 are slightly above front surface 116.

Accordingly, the present disclosure describes a connector with an abutting groove, the connector comprising an insulative body, a plurality of metal terminals and a metal housing, wherein the metal terminals are fixed into the insulative body, and the insulative body can be assembled into the metal housing. The connector is characterized in that a first side wall of the metal housing is provided with at least one snap-fit hole and is at a distance from a corresponding side face of the insulative body to form an abutting groove. Where a further connector is plugged in the connector, an abutting wall of the further connector can extend into the abutting groove, and at least one projecting block protruding from an outer side of the abutting wall can be embedded into the corresponding snap-fit hole. As such, the abutting groove and the snap-fit hole can guide the further connector to be correctly and stably assembled to the connector.

The embodiment of FIGS. 1-7 illustrates a receptacle connector mated with a plug in which the mating direction is at a right angle to the cable entering the plug housing. The techniques as described herein may be used with plugs of other configurations, such as plugs that have a mating direction perpendicular to a cable entering the insulative housing of the plug. FIGS. 8-12 illustrate such an embodiment.

Referring to FIG. 8, in an embodiment, the connector 1' comprises an insulative body 11', a plurality of metal terminals 13 and a metal housing 25. For convenience, the upper part in FIG. 8 is taken as a front side position of the connector, while the lower part in FIG. 4 is taken as a rear side position of the connector.

In the illustrated embodiment, the insulative body 11' is provided at a front side with a plug interface 210 including an accommodation space 211 in insulative body 11'. Within accommodation space 211, two opposite inner side faces of the insulative body 11' are respectively provided with a plurality of terminal slots 214. However, in other embodiments, the insulative body 11' can also be provided with no terminal slots 214, or a tongue plate may additionally be provided in the insulative body 11' and the terminal slots 214 may be provided on the tongue plate. As such, the structure of the present disclosure can be applied to various types of connectors.

Figure 9:
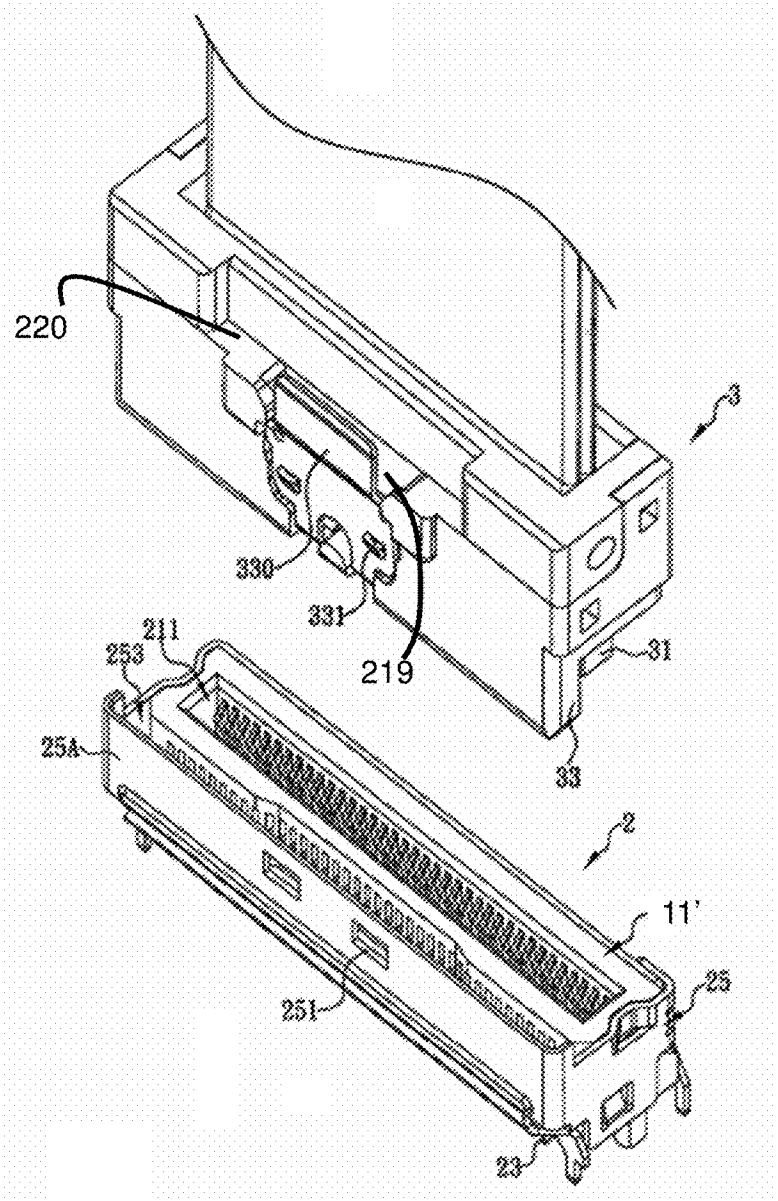
FIG. 9 is a perspective view of the receptacle connector of FIG. 8 in combination with a plug connector in an unmated configuration.

The metal terminals 13 are respectively fixed in the insulative body 11' and are separated from each other at a distance. In the embodiment, the metal terminals 13 can be of any of multiple types, including signal terminals, ground terminals, power terminals, etc., and can be embedded into the respective terminal slots 214. Front ends of the metal terminals 13 can be exposed in the accommodation space 211 to be electrically connected to terminals of a further connector 3. As an example, referring to FIGS. 9 and 10, the further connector 3 is provided with a terminal board 31, and the terminal board 31 is provided with a plurality of terminals (not shown). The further connector 3 is here configured as a plug connector terminated to a cable. When further connector 3 is mated to the connector 1', the terminal board 31 can extend into the accommodation space 211 of the plug interface 210 such that the terminals thereon are electrically connected to front ends of the metal terminals 13, thus being able to exchange signals or currents with each other. Further, rear ends of the metal terminals 13 will extend from a rear end of the insulative body 11' (as shown in FIG. 9) so as to be attached to a circuit board as described above for connector 1.

Referring to FIGS. 8 and 9 again, in the illustrated embodiment, the metal housing 25 is formed by bending a metal plate. The metal plate is bent into a frame shape, encircling an assembly space 250. The insulative body 11' extend into the assembly space 250 and is fixed inside the metal housing 25 (as shown in FIG. 9). Metal housing 25 may prevent electromagnetic interference (EMI), serve as a grounding route, protect the insulative body 11', and/or perform other functions. In the embodiment illustrated, metal housing 25 may include extending portions on the end walls extending towards the printed circuit board to which connector 1' may be mounted. Extending portion 25C1 is visible in the embodiment of FIG. 8 and is shown including a tab to attach metal housing 25 to insulative body 11'. A similar extending portion may be on the opposing end, but is not visible in the orientation of FIG. 8.

At least one snap-fit hole 251 is provided in a first side wall 25A of the metal housing 25. An inner side face of the first side wall 25A is at a distance from a side face corresponding to the insulative body 11' to form an abutting groove 253. That is, the assembly space 250 is greater than the volume of the insulative body 11', such that after the insulative body 11' is assembled to the metal housing 25, a gap between the two will form the abutting groove 253.

At least one first support part 216 (FIGS. 11 and 12) protrudes outward on an outer side of the other side face of the insulative body 11' away from the snap-fit hole 251. In the illustrated embodiment, the first support part 216 is located in the position of the insulative body 11' near the rear end, but is not limited herein. If the overall volume and cost of the connector 1 are not considered, the front side of the first support part 216 can be connected to the area of the insulative body 11' that is adjacent to the front end or a middle section. Further, the first support part 216 is provided with at least an inclined surface 2161. The inclined surface 2161 forms an acute angle θ with an axis L of the insulative body 11'. When the connector 1' is assembled to a circuit board, a bottom face of the first support part 216 can abut against the surface of the circuit board.

Figure 10:
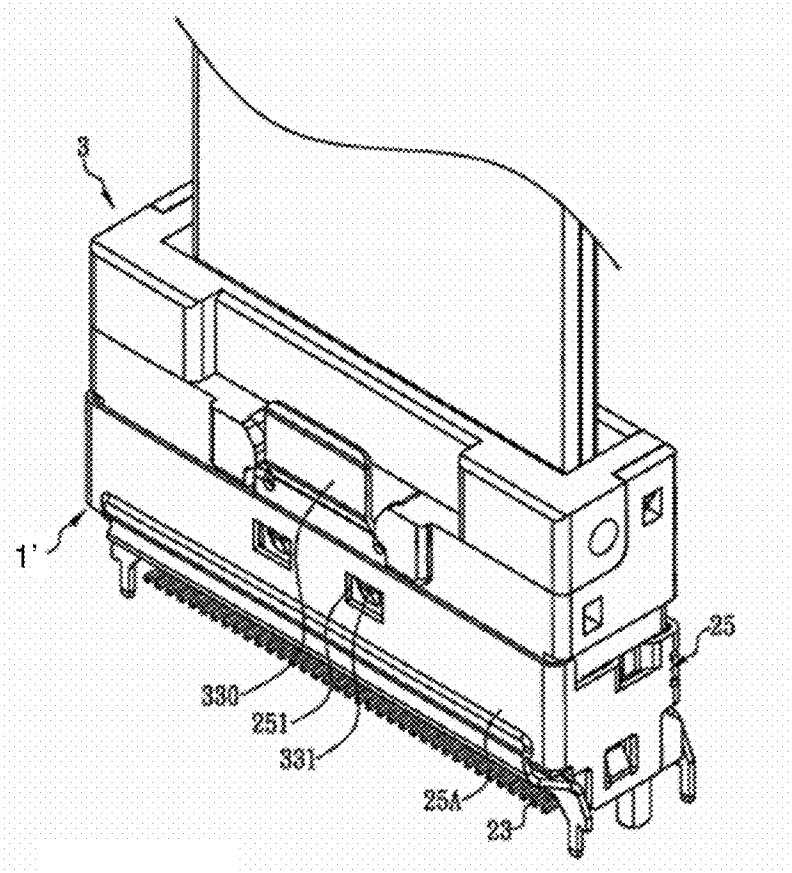
FIG. 10 is a perspective view of the receptacle connector of FIG. 8 in combination with a plug connector in a mated configuration.
Figure 11:
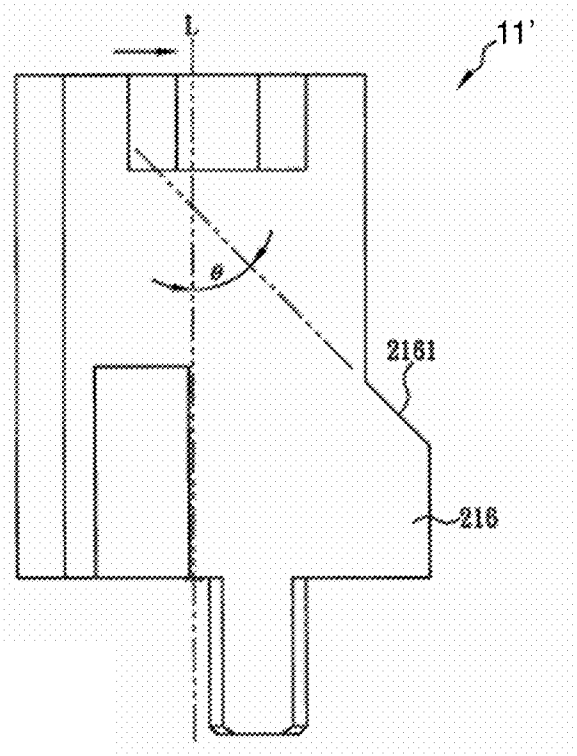
FIG. 11 is a schematic view of an insulation base of the receptacle connector of FIG. 8.

Referring to FIGS. 8-10, the further connector 3 is provided with an abutting wall 33. The extension direction of the abutting wall 33 is the same as that of the terminal board 31, and the abutting wall 33 is at a distance from the terminal board 31.

In the embodiment illustrated, an abutting recess 218 is recessed at the periphery of a top face of the insulative body 11' corresponding to the side face. Providing the housing of receptacle connector 1' with this configuration, and shaping of abutting wall 33 of further connector 3 to conform to the recess 218, may reduce the risk that connectors 1' and further connector 3 will not be fully unlatched when a user attempts to un-mate the connectors. In the embodiment illustrated, the insulative housing of further connector 3 is shaped with a relieved portion 219, which conforms to recess 218.

Figure 12:
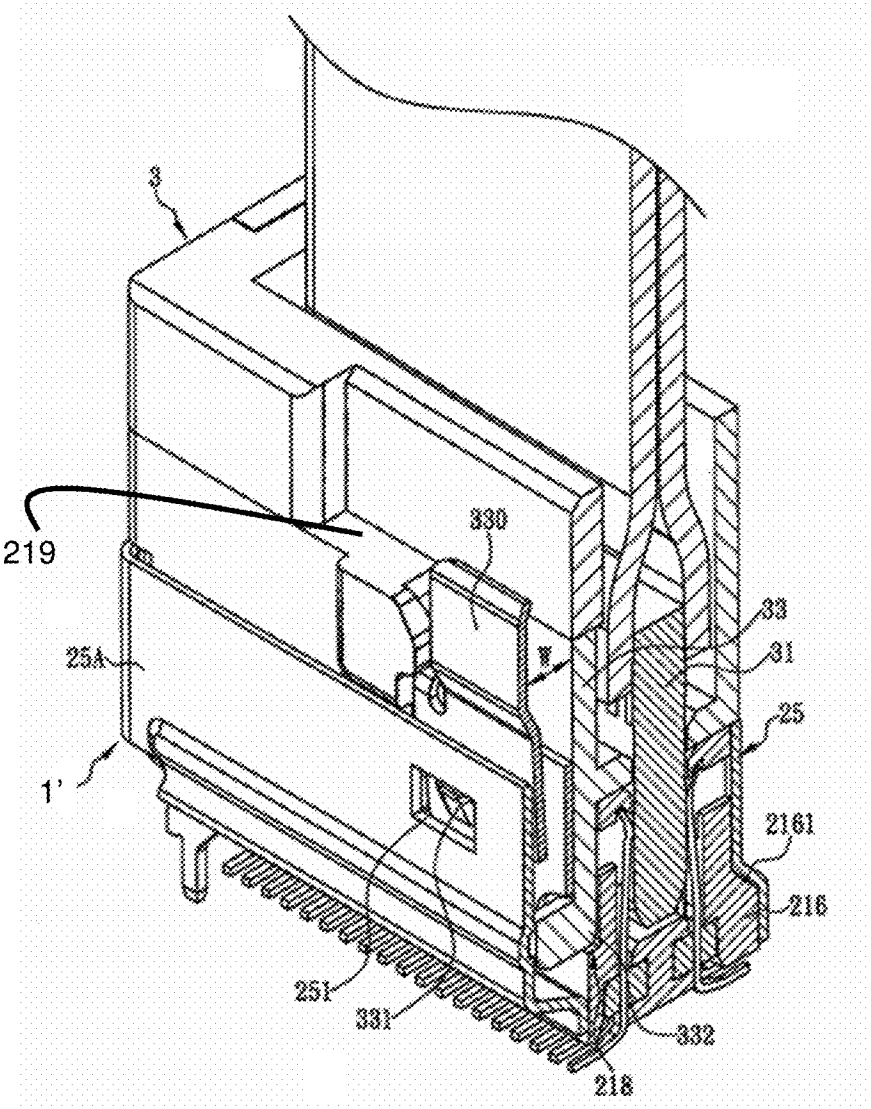
FIG. 12 is a perspective, cut away view of the receptacle connector of FIG. 8 in combination with a plug connector in a mated configuration.

Connector 3 may have a latching component as described above in connection with further connector 2. A pressing piece 330 and at least one projecting block 331 are provided on an outer side face of the abutting wall 33, and an abutting protrusion 332 (as shown in FIG. 12) is provided on an inner side face (i.e. the side face toward the terminal board 31) of the abutting wall 33. A bottom end of the pressing piece 330 can be fixed to the abutting wall 33. A top end of pressing piece 330 keeps a distance from the outer side face of the abutting wall 33, so that the user can press the top end of the pressing piece 330. When pressed by a user, the pressing piece 330 is displaced inwardly (i.e. the direction toward the abutting wall 33). Further, the projecting blocks 331 are located on the pressing piece 330 and move with the pressing piece 330.

When the further connector 3 is plugged into the connector 1' (as shown in FIG. 10), the abutting wall 33 of the further connector 3 extends into the abutting groove 253. At the same time, the projecting blocks 331 can be embedded into the corresponding snap-fit holes 251 such that the connectors 1' and 3 are latched. The abutting protrusion 332 can be accommodated in the abutting recess 218. As a result, the insulative housing of further connector 3 may include relieved portion 219. The relieved portion 219 extends only along a portion of the width of abutting wall 33, enabling the balance of abutting wall 33 to perform guidance and other functions as described above.

The top end of the pressing piece 330 is exposed out of the connector 1'. When the user is to remove the further connector 3, the user can press the top end of the pressing piece 330 with a finger, and at this time, the projecting blocks 331 are detached from the corresponding snap-fit holes 251 so that the user can pull the further connector 3 out of the connector 1'. Pressing piece 330 may be pressed into relieved portion 219, ensuring that pressing piece 330 may be easily moved by a user to unlatch projecting blocks 331 from the corresponding snap-fit holes 251. The insulative housing of further connector 3 may also include a relieved portion 220, which may receive the top end of the pressing piece 330, further ensuring that pressing piece 330 may be easily moved.

In summary, through the structure of this disclosure, the following effects can be achieved:

(1) Since the connector 1' of the present disclosure is provided with a first support part 216 only on one side, compared with the embodiment of FIG. 3, the thickness of the connector 1' can be significantly reduced, and the overall volume of the connector 1' is effectively reduced, so as not to occupy too much space on the circuit board.

(2) With the design of the abutting recess 218, the space of the abutting groove 253 can be increased, and therefore, the abutting wall 33 of the further connector 3, in the region adjacent abutting recess 218 can be offset from first side wall 25A a distance (as shown by W in FIG. 12). The abutting protrusion 332 is formed on the inner side face of the abutting wall 33. As the portion of abutting wall 33 that fits within abutting recess 218 carries the pressing piece 330, pressing piece 330 may have a range of motion equal to the distance W from the for the displacement of the top end of the pressing piece 330, so that the top end of the pressing piece 330 has more space to be pressed and displaced. Even though the overall volume of the connector 1' is reduced, the normal insertion and removal functions between the connector 1' and the further connector 3 can still be performed.

(3) When the user presses the top end of the pressing piece 330, the insulative body 11' is subject to an external force (as shown by an arrow in FIG. 11) which is not parallel to its axis L, as the cross section of the first support part 216 mentioned previously is slightly in the shape of a right-angled triangle (i.e. having a structure with an inclined surface 2161), the first support part can effectively support the bending load of the insulative body 11' that is caused by the external force, such that the bottom face of the insulative body 11' can still stably maintain the current state so as to avoid excessive tilting of insulative body 11' under the external force, which could detach metal terminals 13 from the circuit board to which they are attached.

The disclosed technology is not limited in its application to the details of construction and the arrangement of components set forth in the following description or illustrated in the drawings. The disclosed technology is capable of other embodiments and of being practiced or of being carried out in various ways. Also, the phraseology and terminology used herein is for the purpose of description and should not be regarded as limiting. The use of "including," "comprising," "having," "containing," or "involving," and variations thereof herein, is meant to encompass the items listed thereafter and equivalents thereof as well as additional items.

Having thus described at least one illustrative embodiment of the invention, various alterations, modifications and improvements will readily occur to those skilled in the art.

For example, configurations of the connector 1 or the metal housing 15 of the present disclosure is not limited as illustrated in FIG. 1. Those skilled in the art can adjust the type and shape of each component according to product requirements.

Accordingly, the foregoing description is by way of example only and is not intended to be limiting. The present invention is limited only as defined in the following claims and the equivalents thereto.

What is claimed is:

1. A receptacle connector, comprising:

an insulative body, comprising a front side configured with a plug interface, the plug interface comprising an accommodation space in the insulative body; and a metal housing bounding an assembly space configured to accommodate the insulative body, the insulative body being fixed within the assembly space, wherein:

the metal housing comprises a first side wall and first and second end walls that extend respectively from opposite sides of the first side wall, the first side wall of the metal housing is positioned at a distance from a corresponding side face of the insulative body to form an abutting groove bounded by the side face of the insulative body, the first side wall of the metal housing, and the first and second end walls of the metal housing, the abutting groove is positioned to receive an abutting wall of a plug connector such that, when the plug connector is mated with the receptacle connector, a terminal portion of the plug connector is seated in the accommodation space of the insulative body, a bottom portion of the abutting groove limits an insertion depth of the abutting groove, the bottom portion being configured to prevent the abutting wall of the plug connector from being inserted into the abutting groove beyond the insertion depth when the plug connector is mated with the receptacle connector.

2. The receptacle connector of claim 1, wherein the bottom portion of the abutting groove limits is comprised of a bearing section of the metal housing.

3. The receptacle connector of claim 2, wherein the bearing section of the metal housing extends from the first side wall of the metal housing.

4. The receptacle connector of claim 1, wherein:

a height of the first side wall of the metal housing is greater than a height of the front side of the insulative body, and each of the first and second end walls of the metal housing has a first portion and a second portion, with each of the first portions being positioned adjacent the first side wall of the metal housing and having a height that is same as the height of the first side wall, and with each of the second portions having a height less than the height of the first side wall.

5. The receptacle connector of claim 1, wherein the first side wall of the metal housing comprises at least one snap-fit hole configured to receive and latch with at least one projection on the abutting wall of the plug connector, when the plug connector is mated with the receptacle connector.

6. The receptacle connector of claim 1, wherein internal surfaces of the first portions of the first and second end walls of the metal housing and an internal surface of the first side wall of the metal housing form a guide portion configured to guide the abutting wall of the plug connector into the abutting groove such that the plug connector is aligned with the receptacle connector, when the plug connector is mated with the receptacle connector.

7. The receptacle connector of claim 1, wherein:

the accommodation space in the insulative body is elongated in a width direction of the receptacle connector, and a maximum dimension of the metal housing in the width direction is in a range between 6 mm and 8 mm.

8. The receptacle connector of claim 7, wherein the maximum dimension of the metal housing in the width direction is in a range between 6 mm and 7 mm.

9. The receptacle connector of claim 1, wherein the metal housing further comprises a plurality of legs configured to mount to a circuit board.

10. The receptacle connector of claim 9, wherein the legs extend contiguously from a rear side of the first side wall.

11. The receptacle connector of claim 10, wherein a bearing section separates the first side wall and the legs, the bearing section being contiguous with the first side wall and the legs, and the bearing section having an orientation that is different from an orientation of the legs.

12. The receptacle connector of claim 1, further comprising a plurality of metal terminals embedded in the insulative body, the metal terminals comprising front ends exposed in the accommodation space, and rear ends extending from a rear side of the insulative body.

13. The receptacle connector of claim 12, wherein the insulative body is comprised of terminal slots through which the front ends of the metal terminals are exposed in the accommodation space.

14. The receptacle connector of claim 1, further comprising a plurality of metal terminals, wherein the insulative body comprises a tongue plate configured to support the metal terminals.

15. A metal housing for a receptacle connector, the metal housing comprising:

a first wall;

a second wall facing the first wall;

third and fourth walls respectively extending from each of the first and second walls such that an assembly space is bounded by internal surfaces of the first, second, third, and fourth walls; and a bearing section extending from a rear side of the first wall, the bearing section having an angled surface that is not coplanar with the first wall, wherein:

the assembly space is configured to accommodate an insulative body along the second wall such that the first wall is positioned at a distance from a side surface of the insulative body facing the first wall to form a groove bounded by the side surface of the insulative body, the first wall, the third wall, and the fourth wall, the bearing section forms a bottom surface of the groove to limit a depth of the groove.

16. The metal housing of claim 15, wherein the first wall comprises at least one snap-fit hole configured to receive and latch with at least one projection on a mating connector.

17. The metal housing of claim 15, wherein:

a height of the first wall is greater than a height of the second wall, and each of the third and fourth walls has a first portion and a second portion, with each of the first portions being positioned adjacent the first wall and having a height that is same as the height of the first wall, and with each of the second portions having a height less than the height of the first wall.

18. The metal housing of claim 17, wherein internal surfaces of the first portions of the third and fourth walls and the internal surface of the first wall form a guide portion configured to guide and align a mating connector.

19. The metal housing of claim 15, wherein:

the first wall is elongated in a width direction, and a maximum dimension of the metal housing in the width direction is in a range between 6 mm and 8 mm.

20. A receptacle connector, comprising:

an insulative body comprising a front side configured with a plug interface, the plug interface comprising an accommodation space in the insulative body; and a metal housing bounding an assembly space configured to accommodate the insulative body, the insulative body being fixed within the assembly space, wherein:

the metal housing comprises a first side wall, a second side wall opposite the first side wall and first and second end walls that extend respectively from opposite sides of the first and second side walls, the first side wall of the metal housing is positioned at a distance from a corresponding side face of the insulative body to form an abutting groove bounded by the side face of the insulative body, the first side wall of the metal housing, and the first and second end walls of the metal housing, the abutting groove is positioned to receive an abutting wall of a plug connector such that, when the plug connector is mated with the receptacle connector, a terminal portion of the plug connector is seated in the accommodation space of the insulative body, the first side wall extends above the front side of the insulative body and at least portions of the second side wall and first and second end walls are aligned with the front side.

* * * * *